US010255859B2

(12) United States Patent
Wang et al.

(10) Patent No.: US 10,255,859 B2
(45) Date of Patent: Apr. 9, 2019

(54) PIXEL COMPENSATING CIRCUIT AND DRIVING METHOD THEREOF, ARRAY SUBSTRATE AND DISPLAY DEVICE

(71) Applicants: BOE TECHNOLOGY GROUP CO., LTD., Beijing (CN); ORDOS YUANSHENG OPTOELECTRONICS CO., LTD., Ordos, Inner Mongolia (CN)

(72) Inventors: Bo Wang, Beijing (CN); Minghua Xuan, Beijing (CN); Zhanjie Ma, Beijing (CN)

(73) Assignees: BOE TECHNOLOGY GROUP CO., LTD., Beijing (CN); ORDOS YUANSHENG OPTOELECTRONICS CO., LTD., Ordos, Inner Mongolia (CN)

( * ) Notice: Subject to any disclaimer, the term of this patent is extended or adjusted under 35 U.S.C. 154(b) by 64 days.

(21) Appl. No.: 15/529,301

(22) PCT Filed: Oct. 31, 2016

(86) PCT No.: PCT/CN2016/103971
§ 371 (c)(1),
(2) Date: May 24, 2017

(87) PCT Pub. No.: WO2017/080379
PCT Pub. Date: May 18, 2017

(65) Prior Publication Data

US 2017/0263186 A1 Sep. 14, 2017

(30) Foreign Application Priority Data

Nov. 12, 2015 (CN) ..... 2015 1 0771502

(51) Int. Cl.
*G09G 3/3258* (2016.01)
*G09G 3/3233* (2016.01)
(Continued)

(52) U.S. Cl.
CPC ..... *G09G 3/3258* (2013.01); *G09G 3/3233* (2013.01); *G09G 3/3266* (2013.01);
(Continued)

(58) Field of Classification Search
CPC .. G09G 3/3266; G09G 3/3291; G09G 3/3233; G09G 2300/043
See application file for complete search history.

(56) References Cited

U.S. PATENT DOCUMENTS 7,218,296 B2 5/2007 Wang et al.
8,982,017 B2 3/2015 Lee et al.
(Continued)

FOREIGN PATENT DOCUMENTS

CN 1417767 A 5/2003
CN 103226931 A 7/2013
(Continued)

OTHER PUBLICATIONS

The Second Chinese Office Action dated Sep. 15, 2017; Appln. 201510771502.9.
(Continued)

*Primary Examiner* — Abbas I Abdulselam
(74) *Attorney, Agent, or Firm* — Ladas & Parry LLP

(57) ABSTRACT

A pixel compensating circuit and a driving method thereof, an array substrate and a display device. The pixel compensating circuit includes: a reset circuit, connected with a reset signal line, and configured to reset a driving circuit according to a reset signal from the reset signal line; the driving circuit, configured to output a driving current to drive a display apparatus to emit light and display; a compensating
(Continued)

circuit, connected with a signal control line, and a data line, and configured to compensate a threshold voltage for the driving circuit and write data into the driving circuit under control of a signal control signal from the signal control line; and a luminance control circuit, connected with a luminance control line, and configured to control the driving circuit to drive the display apparatus to emit light and display according to a luminance control signal from the luminance control line.

20 Claims, 3 Drawing Sheets

(51) Int. Cl.
*G09G 3/3266* (2016.01)
*G09G 3/3291* (2016.01)

(52) U.S. Cl.
CPC ..... *G09G 3/3291* (2013.01); *G09G 2300/043* (2013.01); *G09G 2300/0809* (2013.01); *G09G 2300/0819* (2013.01); *G09G 2300/0842* (2013.01); *G09G 2300/0861* (2013.01); *G09G 2310/061* (2013.01); *G09G 2320/045* (2013.01); *G09G 2320/0646* (2013.01)

(56) References Cited

U.S. PATENT DOCUMENTS 9,159,266 B2 * 10/2015 Kim ..... G09G 3/3233
2003/0103022 A1 6/2003 Noguchi et al.
2011/0193856 A1 8/2011 Han
2013/0300724 A1 * 11/2013 Chaji ..... G09G 3/3233 345/212
2014/0071112 A1 * 3/2014 Han ..... G06F 3/038 345/212
2014/0168180 A1 6/2014 Kim
2015/0221251 A1 8/2015 Wang
2016/0275866 A1 9/2016 Liu et al.
2016/0329383 A1 * 11/2016 Li ..... H01L 51/5218
2016/0372049 A1 12/2016 Wang et al.
2017/0116918 A1 4/2017 Dong et al.

FOREIGN PATENT DOCUMENTS

CN 104050917 A 9/2014
CN 203882587 U 10/2014
CN 104157240 A 11/2014
CN 104217682 A 12/2014
CN 104809989 A 7/2015
CN 105243986 A 1/2016

OTHER PUBLICATIONS

The First Chinese Office Action dated Oct. 25, 2016, Appln. No. 201510771502.9.
International Search Report and Written Opinion dated Feb. 3, 2017; PCT/CN2016/103971.

* cited by examiner

PIXEL COMPENSATING CIRCUIT AND DRIVING METHOD THEREOF, ARRAY SUBSTRATE AND DISPLAY DEVICE

TECHNICAL FIELD

Embodiments of the present disclosure relate to an active-matrix organic light-emitting diode field, and in particular, to a pixel compensating circuit for an active-matrix organic light-emitting diode display panel and a driving method thereof, an array substrate comprising the pixel compensating circuit and a display device.

BACKGROUND

AMOLED (Active-matrix organic light-emitting diode) is a kind of display technologies applied in televisions and mobile devices. A display screen using the AMOLED technology obtains favor of various customers and is well received, and at the same time, a next AMOLED display technology related to low temperature poly-silicon liquid crystal display (LTPS-LCD) has been developed.

Compared with a traditional display technology, the AMOLED has the following advantages:

1. Compared with a liquid crystal box technology of the traditional LCD, the AMOLED dose not need liquid crystals, and can achieve self-luminance only through a very thin organic light-emitting layer, and therefore the AMOLED can be lighter and thinner, and in a market where an ultra-thin machine needs to be lighter and thinner, the AMOLED has an insurmountable advantage;

2. The AMOLED can break through restriction of the traditional RGB pixel arrangement, can implement a pentle pixel structure and achieve an effect of a high resolution;

3. The AMOLED achieves a display function by adopting the principle of self-luminance; when an image shows black, pixels do not need to illuminate, while the LCD is also in a working state when showing black; and so by comparison, the AMOLED can not only achieve a high contrast, but also can reduce power consumption to achieve an effect of saving electricity;

4. The AMOLED can realize flexible display; by using a special technology, a circuit of the AMOLED can be implemented on a flexible substrate to realize flexible display;

5. The AMOLED and a SUPER AMOLED have very wide color gamut, but have color deviation.

However, the AMOLED as a high-end display technology have strict requirements on a manufacturing process. There are difficulties from the manufacturing of a driving circuit to subsequent evaporating of an organic light emitting layer, which is the reason why at the present stage, breaking the manufacturing yield of the AMOLED is a difficult problem which is needed to be considered.

OLED refers to a phenomenon that, under the driving of an electric field, a semiconductor material and a luminescent material lead to light emission through the carrier injection and recombination. The luminescence principle of the OLED includes: by adopting an indium tin oxides (ITO) transparent electrode and a metal electrode as an anode and a cathode respectively, under a certain driving voltage, electrons and holes are injected from the cathode and the anode into an electron transport layer and a hole transport layer respectively, the electrons and the holes migrate through the electron transport layer and the hole transport layer respectively to a light emitting layer, and meet in the light emitting layer to form excitons and excite the luminescent molecules, and the luminescent molecules emit visible light through radiative relaxation. The radiation light can be observed from the side of the ITO, and the metal electrode film also acts as a reflector.

Apparently, it is completely different from the luminescence mechanism of a twisted nematic (TN) display technology. The two types of panels adopt different light sources. The OLED (Organic Light-Emitting Diode) emits light by self, and the TN display adopts a backlight source. By contrast it is not difficult to find that the OLED has advantages such as thinner and lighter, active luminescence (no backlight source), no viewing angle problem, high definition, high brightness, fast response, low power consumption, wide usage temperature range, strong anti-shock capacity, low cost and flexible display, etc., where many of these features are difficult to achieve by a thin film transistor (TFT) liquid crystal panel.

The OLED describes an organic electroluminescent display which is a specific type of the thin film display technology. AM (active matrix) refers to a pixel addressing technology. The characteristic of self-luminance of the AMOLED leads to a key influence of the driving circuit for the light uniformity. In the present driving circuit, threshold voltages of driving thin film transistors which each drive a light emitting diode in each pixel are not uniform, which leads that even if the driving voltages applied to each driving thin film transistor are the same, the current flowing through each OLED may be different, so as to affect display effects.

SUMMARY

Other aspects and advantages of the present disclosure will be described in the following description, and some advantages may be clearly seen from the description, or may be obtained in the practice of the present disclosure.

The present disclosure relates to a new structure design of an AMOLED pixel compensating circuit.

The present disclosure provides an active-matrix organic light-emitting diode pixel compensating circuit, comprising: a reset circuit, connected with a reset signal line and a driving circuit, and configured to reset the driving circuit according to a reset signal inputted from the reset signal line; the driving circuit, configured to output a driving current to drive a display apparatus to emit light and display; a compensating circuit, connected with a signal control line, a data line and the driving circuit, and configured to compensate a threshold voltage for the driving circuit and write data into the driving circuit under control of a signal control signal inputted from the signal control line; and a luminance control circuit, connected with a luminance control line, the driving circuit and an anode of the display apparatus, and configured to control the driving circuit to drive the display apparatus to emit light and display according to a luminance control signal inputted from the luminance control line.

The present disclosure further provides an array substrate, comprising the above mentioned pixel compensating circuit.

The present disclosure further provides an active-matrix organic light-emitting diode display device, comprising the above mentioned array substrate.

The present disclosure further provides a driving method for the pixel compensating circuit, comprising: during a reset phase, applying an effective reset signal to the reset signal line to turn on the reset circuit, so as to reset the driving circuit; during a signal control phase, applying an effective signal control signal to the signal control line to compensate the threshold voltage for the driving circuit and write the data into the driving circuit; and during a luminance control phase, applying an effective luminance control signal to the luminance control line to turn on the luminance control circuit, so as to control the driving circuit to drive the display apparatus to emit light and display.

Based on a current driving principle of the self-luminance AMOLED and using the principle of the compensating circuit, the present disclosure compensates influence of the threshold voltage Vth on the AMOLED driving current, so as to obtain an AMOLED pixel driving circuit which uniformly emits light.

Aiming to solve existing problems, the present disclosure designs a new type of circuit, which can effectively improve the uniformity of the driving current, and the circuit is more suitable for a high resolution circuit design.

The present disclosure designs an AMOLED pixel compensating circuit with 8T1C, which can effectively avoid the influence of the threshold voltage on the driving current, and the signal lines are reduced, which is more favorable for a mask design of a TFT substrate in a high resolution display screen.

The current formula for driving the light-emitting diode in each pixel of an OLED display in the present disclosure is $I_{OLED}=(V_{ref}-V_{data})^2$, the driving current is not related to $V_{th}$, and the value of the driving current is only related to the data voltage $V_{data}$, so that the brightness and darkness of the display screen can be achieved by adjusting the value of the $V_{data}$.

BRIEF DESCRIPTION OF THE DRAWINGS

The preferred embodiments of the present disclosure will be described in detail in connection with the drawings, the above and other purposes, characteristics and advantages of the present disclosure will become more clear, wherein the same labels refer to the same structures, and therein.

DETAILED DESCRIPTION

Figure 1:
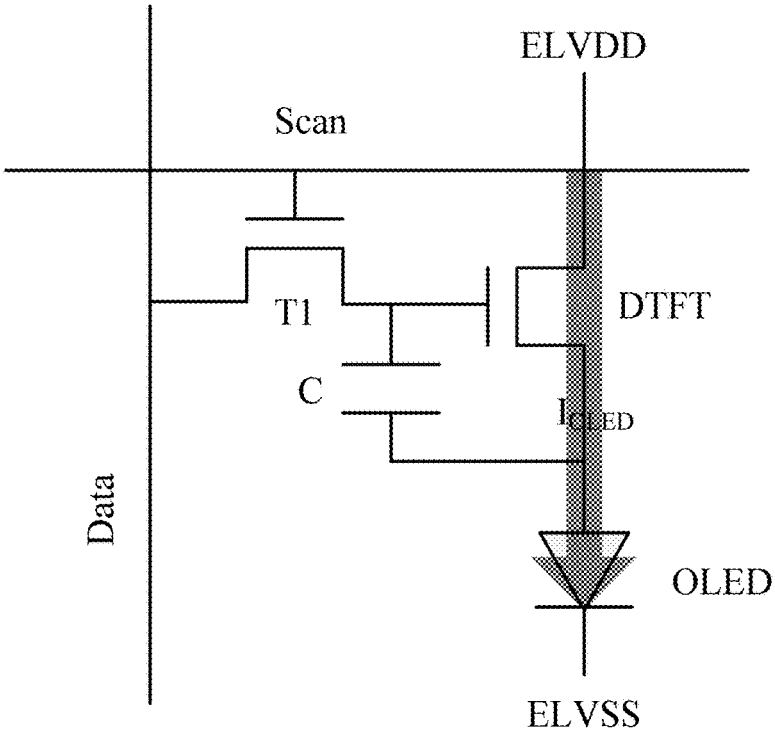
FIG. 1 schematically shows a traditional AMOLED driving circuit with 2T1C.

The present disclosure will be described in a fully understandable way in connection with the drawings showing the embodiments of the present disclosure in the following. However, the present disclosure can be implemented in many different forms, and should not be limitative to the embodiments described herein. On the contrary, these embodiments are provided to describe the disclosure in a clearly and fully understandable way and fully express the scope of the disclosure to those skilled in the art. In the drawings, the components are enlarged for the sake of clarity.

It should be understood that although the terms "first," "second," "third," etc., are used to describe the elements, components and/or parts, the elements, components and/or parts are not limited to these terms. These terms are only used to distinguish various elements, components or parts. Therefore, a first element, component or part discussed below can be described as a second element, component or part without departing from the teaching of the disclosure.

In the present disclosure, when describing a particular apparatus being located between a first apparatus and a second apparatus, an intermediate apparatus may exist between the particular apparatus and the first apparatus or the second apparatus, and the intermediate apparatus also may not exist; when describing the particular apparatus being connected with other apparatuses, the particular apparatus can be directly connected with the other apparatuses without an intermediate apparatus, and can be not directly connected with the other apparatuses but having an intermediate apparatus.

Unless otherwise defined, all the terms (comprising the technical and scientific terms) used herein have the same meanings as commonly understood by one of ordinary skill in the art to which the present disclosure belongs. It is also understood that the terms such as defined in the usual dictionary should be interpreted as having the same meanings as the meaning in the context of the relevant technology, and the terms should not be interpreted as an idealization or extreme meanings, unless they are explicitly defined herein.

A traditional AMOLED driving circuit is shown in FIG. 1. A simplest traditional AMOLED driving circuit usually adopts a pixel structure with 2T1C, and the 2T1C driving circuit comprises two thin film transistors (TFT) and a capacitor. A transistor T1 is used to control writing of a voltage $V_{data}$ from a data line and is referred to as a switching TFT, a transistor DTFT is used to control a working state of an OLED and is referred to as a driving TFT, and a capacitor C is used to maintain a voltage of a gate electrode of the driving TFT. A gate electrode of the switching TFT T1 is connected with a scan line Scan, a source electrode of the switching TFT T1 is connected with a data line Data, and a drain electrode of the switching TFT T1 is connected with a gate electrode of the driving TFT; a source electrode of the driving TFT is connected with a supply voltage ELVDD, and a drain electrode of the driving TFT is connected with an anode of the OLED; a cathode of the OLED is connected with a low voltage level ELVSS; the capacitor C is connected in parallel between the gate electrode of the driving TFT and the drain electrode of the driving TFT.

An output current of the pixel circuit is unstable, which can not make the whole display screen to display uniformly. A driving current, namely a working current of the OLED, can be expressed as $I_{OLED}=K(V_{SG}+V_{th})^2$, where the $V_{GS}$ is is a source gate voltage of the driving transistor, $V_{th}$ is a threshold voltage of the driving transistor, and K is a coefficient.

It can be seen clearly from the working principle of a current driving circuit that the driving current has a direct relationship with the threshold voltage $V_{th}$. Usually, an input voltage corresponding to a midpoint of a region where an output voltage varies rapidly with changing of an input voltage in a transfer characteristic curve is referred to as the threshold voltage. Usually we define the value of Vgs in the TFT transfer curve as the threshold voltage when Vds is −0.1V and Ids is 10 nA. The Vth varies according to the conditions of the TFT such as a forming process. For each TFT of the display screen, a phenomenon that the Vth of each TFT is different may exist. Thus, if a value of the driving current is related to a value of the threshold voltage Vth, it is inevitable that the driving current of each pixel compensating circuit in the display screen is different, which leads to a situation of a non-uniform luminance of the whole display screen.

Therefore, it is expected to improve a driving circuit for driving the OLED to solve one or more of the above problems. That is to say, it is expected to avoid an influence of the threshold voltage of the driving TFT on the luminance of the OLED.

Considering this, the present disclosure provides a pixel compensating circuit, which can compensate a threshold voltage of a driving TFT and eliminate an influence of the threshold voltage of the driving TFT on a working current of a driving OLED during emission of light and displaying, so as to enhance display effect. In addition, the pixel compensating circuit according to the present disclosure also achieves an effect of saving signal lines.

Figure 2:
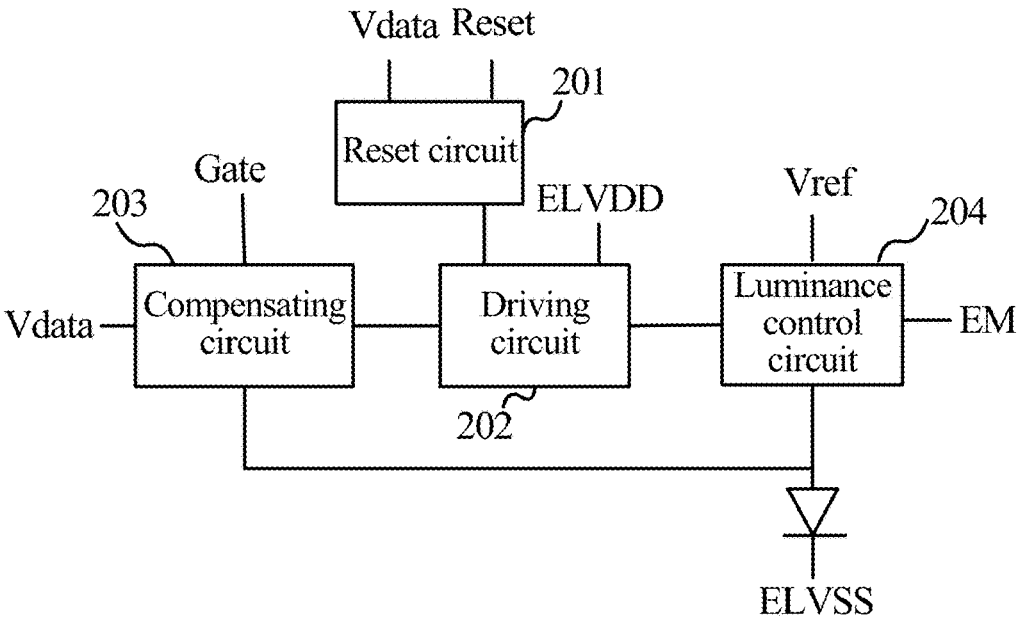
FIG. 2 schematically shows a structure diagram of an AMOLED pixel compensating circuit according to an embodiment of the present disclosure.

FIG. 2 schematically shows a structure diagram of an AMOLED pixel compensating circuit according to an embodiment of the present disclosure.

The AMOLED pixel compensating circuit illustrated in FIG. 2 comprises:

a reset circuit 201, connected with a reset signal line Reset, a data line Data and a driving circuit 202, and configured to reset the driving circuit 202 according to a reset signal inputted from the reset signal line Reset;

a driving circuit 202, configured to output a driving current to drive a display apparatus to emit light and display;

a compensating circuit 203, connected with a signal control line Gate, the data line Data, the driving circuit 202 and an anode of the display apparatus, and configured to compensate a threshold voltage for the driving circuit 202 and write data into the driving circuit 202 under the control of a signal control signal inputted from the signal control line Gate; and a luminance control circuit 204, connected with a luminance control line EM, the driving circuit 202, the anode of the display apparatus and a reference voltage end Vref, and configured to control the driving circuit 202 to drive the display apparatus to emit light and display according to a luminance control signal inputted from the luminance control line EM.

Figure 3:
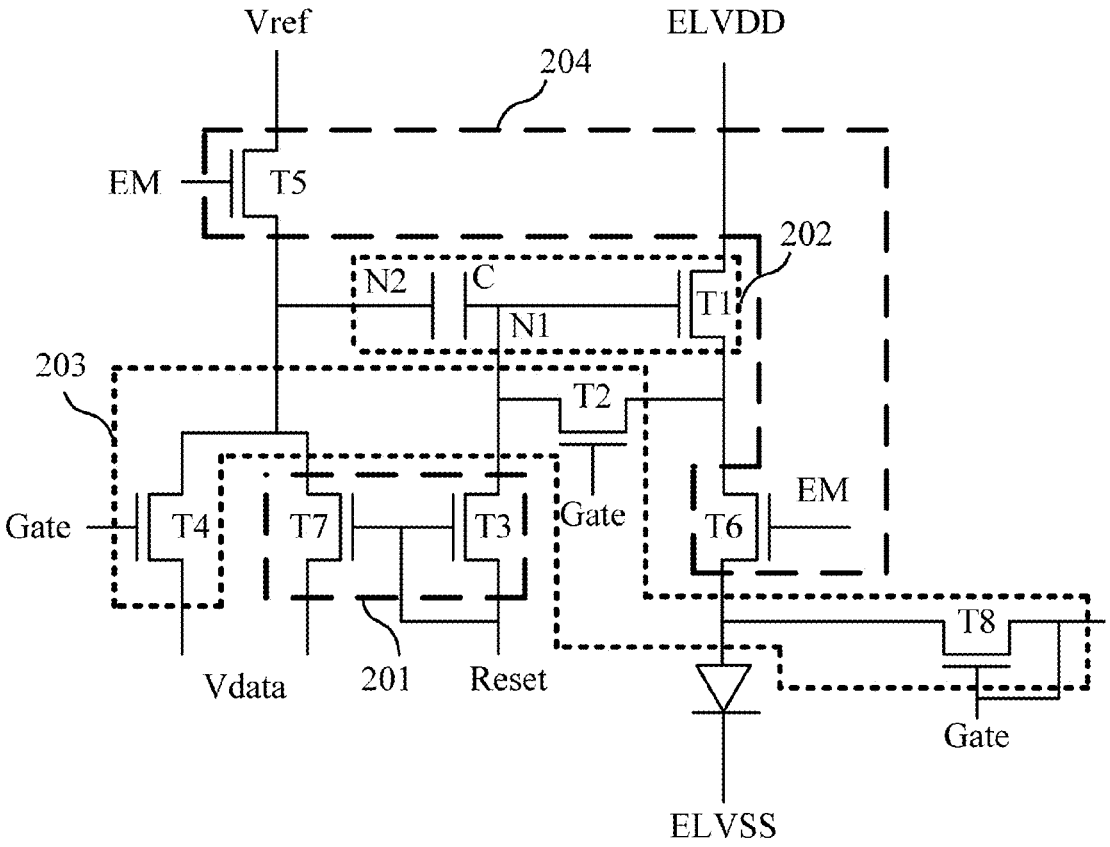
FIG. 3 schematically shows a specific structure of an AMOLED pixel compensating circuit according to an embodiment of the present disclosure.

FIG. 3 schematically shows a specific structure of an AMOLED pixel compensating circuit according to an embodiment of the present disclosure.

Specifically, the driving circuit 202 comprises: a first transistor T1, a gate electrode of the first transistor T1 connected with a first node N1, a source electrode of the first transistor T1 connected with a first voltage end ELVDD, and a drain electrode of the first transistor T1 connected with the luminance control circuit 204 and the compensating circuit 203; and a capacitor C, two ends of the capacitor C being respectively shown as the first node N1 and a second node N2 in the figure, and the second node N2 connected with the reset circuit 201, the compensating circuit 203 and the luminance control circuit 204.

The reset circuit 201 comprises: a third transistor T3, a gate electrode of the third transistor T3 connected with a source electrode of the third transistor T3 and a gate electrode of a seventh transistor T7, and connected with the reset signal line Reset, a drain electrode of the third transistor T3 connected with the first node N1; and the seventh transistor T7, the gate electrode of the seventh transistor T7 connected with the reset signal line Reset, a source electrode of the seventh transistor T7 connected with the data line Data, and a drain electrode of the seventh transistor T7 connected with the second node N2.

The compensating circuit 203 comprises: a second transistor T2, a gate electrode of the second transistor T2 connected with the signal control line Gate, a source electrode of the second transistor T2 connected with the drain electrode of the first transistor T1, and a drain electrode of the second transistor T2 connected with the first node N1; and a fourth transistor T4, a gate electrode of the fourth transistor T4 connected with the signal control line Gate, a source electrode of the fourth transistor T4 connected with the data line Data, and a drain electrode of the fourth transistor connected with the second node N2.

In addition, the compensating circuit 203 further comprises an eighth transistor T8, a gate electrode of the eighth transistor T8 connected with a source electrode of the eighth transistor T8 and the signal control line Gate, and a drain electrode of the eighth transistor T8 connected with the anode of the display apparatus.

The luminance control circuit 204 comprises: a fifth transistor T5, a gate electrode of the fifth transistor T5 connected with the luminance control line EM, a source electrode of the fifth transistor T5 connected with a reference voltage end Vref, and a drain electrode of the fifth transistor T5 connected with the second node N2; and a sixth transistor T6, a gate electrode of the sixth transistor T6 connected with the luminance control line EM, a source electrode of the sixth transistor T6 connected with the drain electrode of the first transistor T1, and a drain electrode of the sixth transistor T6 connected with the anode of the display apparatus.

For example, in the above mentioned embodiment, the display apparatus is an OLED, the anode of the display apparatus is connected with the drain electrode of the sixth transistor T6, and the cathode of the display apparatus is connected with a second voltage end ELVSS.

For example, in FIG. 3, all the transistors are P type thin film transistors, so as to simplify the manufacturing process of the circuits and improve the production efficiency. According to needs, some or all of the transistors can also adopt N type TFTs, as long as a voltage level of each corresponding control signal is adjusted, and the specific connection relationship is omitted here.

For example, in the present disclosure, except the gate electrode as a control electrode of the transistor, one electrode of the transistor used for inputting a signal is referred to as a source electrode, and the other electrode of the transistor used for outputting a signal is referred to as a drain electrode. However, considering the symmetry of the source electrode and the drain electrode of the transistor, the two electrodes can be exchanged, which will not affect the technical solution of the present disclosure.

In addition, in the above mentioned embodiment, the transistor T1 is a driving transistor, and the other transistors are switching transistors.

Figure 4:
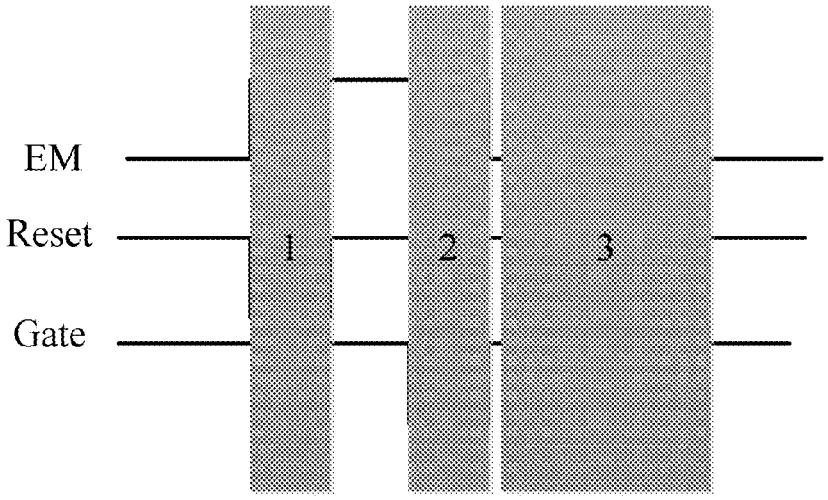
FIG. 4 schematically shows a timing sequence diagram of the pixel compensating circuit described in FIG. 3.

FIG. 4 shows a timing sequence diagram of the pixel compensating circuit described in FIG. 3. The operation of the circuit can be divided into 3 parts. The voltage signal ELVDD which is not shown in the figure is a DC voltage, the voltage value of the ELVDD is 3V~5V, and Vref is a DC voltage, the voltage value of the Vref is identical to the voltage value of the ELVDD; a pixel working sequence of one frame is shown in the figure, a high voltage is about 4V~7V, a low voltage is about −4V~−7V, and $V_{init}$ is −3V, a normal operation of the pixel can be realized in the given voltage range.

Figure 5:
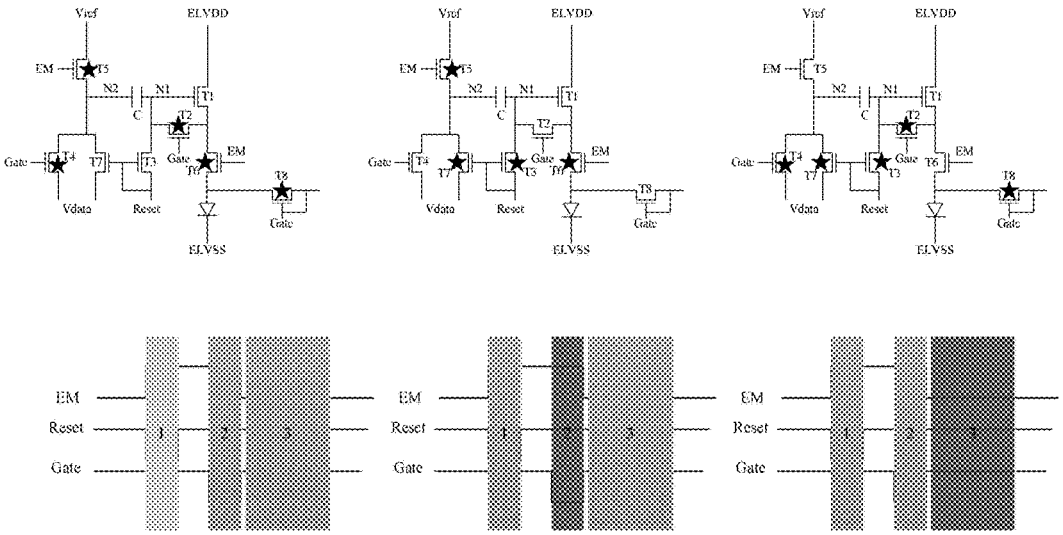
FIG. 5 schematically shows a schematic diagram of 3 phases of the pixel compensating circuit described in FIG. 3 during operation.

Referring to the timing sequence relationship of the signals shown in FIG. 4 and combined with the schematic working diagram of the pixel compensating circuit in each phase shown in FIG. 5, the working process of the pixel compensating circuit shown in FIG. 4 will be briefly described below. In FIG. 5, a TFT labeled by a star indicates a TFT being switched off.

For example, the reset signal, the signal control signal and the luminance control signal respectively correspond to a reset phase, a signal control phase and a luminance control phase. During a first phase of operation of the pixel compensating circuit, namely, during the reset phase, as illustrated in FIG. 4, the reset signal Reset provides a low voltage level, and the signal control signal and the luminance control signal both provide high voltage levels.

At this point, referring to FIG. 5, since the reset signal Reset provides a low voltage level, the third transistor T3 and the seventh transistor T7, the gate electrodes of which are connected with the reset signal Reset, are turned on. This process is intended to restore potential of the capacitor C which stores potential in the last frame, so that voltages of the two ends N1 and N2 of the capacitor C are Vreset and Vdata respectively, thus resetting the previous potential; meanwhile, because the gate electrodes of the transistors T2, T4, T5, T6 and T8 are not provided with an effective turn-on voltage, so they are in the turn-off state.

During a second phase of operation of the pixel compensating circuit, namely, during the signal control phase, as illustrated in FIG. 4, the reset signal Reset is changed from providing the low voltage level to providing a high voltage level, the signal control signal Gate is changed from providing a high voltage level to providing a low voltage level, and the luminance control signal EM remains the previous high voltage level.

At this point, referring to FIG. 5, since the reset signal Reset provides a high voltage level, the third transistor T3 and the seventh transistor T7 are turned off; since the signal control signal Gate provides a low voltage level, therefore the second transistor T2, the fourth transistor T4, and the eighth transistor T8, the gate electrodes of which are connected with the signal control signal Gate, are turned on. The data line DATA provides the data voltage Vdata to the second node N2 through the conductive fourth transistor 14; since the first node N1 has been reset to a low potential, after the second transistor T2 is turned on, the First transistor T1 at this point forms a diode connection. According to the characteristics of the diode, the potential VELVDD+Vth is stored in the N1 node (the value is obtained according to the electrical characteristic of the diode), and the T8 transistor at this point resets an OLED which emits light at a previous stage; in addition, since the sixth transistor T6 is in the turn-off state, so there is no current flowing through the display apparatus OLED, which indirectly reduces the life loss of the OLED and at the same time ensure that there is no current flowing through the OLED except during the luminance phase.

During a third phase of the pixel compensating circuit, namely, during the luminance phase, as illustrated in FIG. 4, the luminance control line EM provides a low voltage level, and the reset signal Reset and the signal control signal Gate both provide high voltage levels.

At this point, referring to FIG. 5, the transistors T2, T4 and T8 are both in the turn-off state, the transistors T3 and T7 also are in the turn-off state, but the transistors T5 and T6 are turned on. At this point, the potential of the N2 is Vref. According to the characteristic of the capacitor, the voltage of the other end N1 of the capacitor is changed to Vref+$V_{ELVDD}$+Vth−Vdata; according to a formula of the OLED driving current: $I=K(Vgs-Vth)^2$ the driving current at this point can be obtained by the formula: $I=K((Vref+V_{ELVDD}+Vth-Vdata)-V_{ELVDD}-Vth)^2=K(Vref-Vdata)^2$.

It can be seen from the above formula that the driving current, namely, the working current $I_{OLED}$ supplied to the display apparatus has been not being affected by the Vth, and is only related to the data voltage Vdata, thereby eliminating the influence of the threshold voltage Vth on the working current of the display apparatus and ensuring the uniformity of the display image. And, the $V_{data}$ can control the voltage of luminance of the OLED. When the voltage is different, the OLED current is different and the brightness of the OLED is different, so as to control displaying different gray scales. Therefore, the brightness and darkness of the display screen can be achieved by adjusting the value of the $V_{data}$.

According to an embodiment of the present disclosure, an array substrate is further provided and comprises any one of the above mentioned pixel compensating circuit.

According to another embodiment of the present disclosure, a display device is further provided and comprises the above mentioned array substrate. The display device can be an AMOLED monitor, a television, a digital photo frame, a mobile photo, a tablet computer, or any product or components having any display function.

Figure 6:
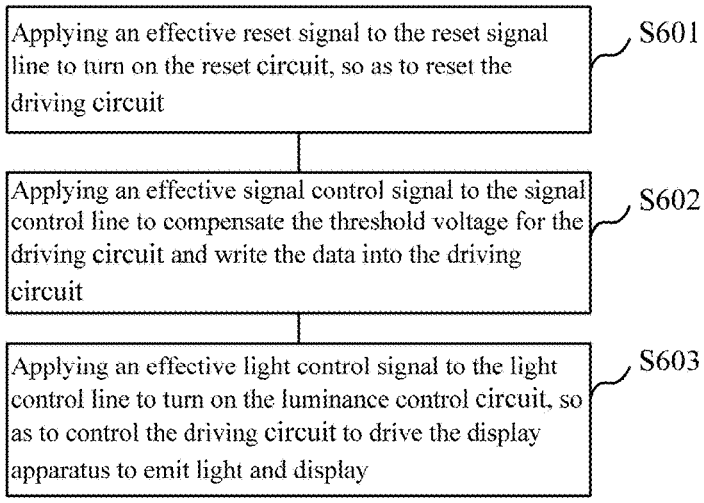
FIG. 6 schematically shows a flow chart of a driving method for a pixel compensating circuit according to an embodiment of the present disclosure.

FIG. 6 schematically shows a flow chart of a driving method for the pixel compensating circuit according to an embodiment of the present disclosure.

According to an embodiment of the present disclosure, a driving method for the above mentioned pixel compensating circuit is further provided, and comprises: during a reset phase, applying an effective reset signal to the reset signal line to turn on the reset circuit, so as to reset the driving circuit (S601); during a signal control phase, applying an effective signal control signal to the signal control line to compensate the threshold voltage for the driving circuit and write the data into the driving circuit (S602); and during a luminance control phase, applying an effective luminance control signal to the luminance control line to turn on the luminance control circuit, so as to control the driving circuit to drive the display apparatus to emit light and display (S603).

For example, applying the effective reset signal to the reset signal line to reset the driving circuit comprises: turning on the third transistor T3 and the seventh transistor T7 through the effective reset signal, so as to respectively provide the voltages Vreset and Vdata to the first node N1 and the second node N2.

For example, applying the effective signal control signal to the signal control line to compensate the threshold voltage for the driving circuit and write the data into the driving circuit comprises: turning on the second transistor T2 and the fourth transistor T4 through the effective signal control signal to pre-charge the capacitor, so as to write the data and information comprising a threshold voltage of the driving transistor T1 into the capacitor.

For example, applying the effective luminance control signal to the luminance control line to control the driving circuit to drive the display apparatus to emit light and display comprises: turning on the fifth transistor T5 and the sixth transistor T6 through the effective luminance control signal so as to apply the data voltage with threshold voltage compensation to the gate electrode and the source electrode of the driving transistor and turn on the driving transistor to drive the light emitting device to emit light and display.

To sum up, the 8T1C AMOLED pixel compensating circuit and the driving method thereof provided according to the present disclosure can effectively avoid the influence of the threshold voltage on the driving current, and eliminate an influence of the driving current, which flows through the display apparatus, due to the non-uniform threshold voltage Vth of each pixel driving TFT caused by the manufacturing process and device aging. Thus, display uniformity is ensured, so as to enhance display effect. And the signal lines are reduced, which is more favorable for a mask design of a TFT substrate in a high resolution display screen.

What are described above is a description of the present disclosure only and should not be considered to limit the present disclosure. Although a number of exemplary embodiments of the present disclosure are described, the person skilled in the art will easily understand that, various modification can be made to the exemplary embodiments without departing from the novelty teaching and advantages of the present disclosure. Therefore, it is intended to include these modification in the present disclosure scope defined by the claims. It should be understood that, what are described above is a description of the present disclosure only and is not considered to limit the present disclosure to the specific embodiment, and it is intended to include the modification of the disclosure embodiments and other embodiments in the present disclosure scope defined by the claims. The present disclosure is defined by the claims and its equivalents.

The application claims priority to the Chinese patent application No. 201510771502.9 filed Nov. 12, 2015, the entire disclosure of which is incorporated herein by reference as part of the present application.

What is claimed is:

1. A pixel compensating circuit for an active-matrix organic light-emitting diode, comprising:

a reset circuit, connected with a reset signal line and a driving circuit, and configured to reset the driving circuit according to a reset signal inputted from the reset signal line;

the driving circuit, configured to output a driving current to drive a display apparatus to emit light and display;

a compensating circuit, connected with a signal control line, a data line and the driving circuit, and configured to compensate a threshold voltage for the driving circuit and write data into the driving circuit under control of a signal control signal inputted from the signal control line; and a luminance control circuit, connected with a luminance control line, the driving circuit and an anode of the display apparatus, and configured to control the driving circuit to drive the display apparatus to emit light and display according to a luminance control signal inputted from the luminance control line, wherein the driving circuit comprises:

a first transistor, a control electrode of the first transistor connected with a first node, a first electrode of the first transistor connected with a first voltage end, and a second electrode of the first transistor connected with the compensating circuit and the luminance control circuit; and a capacitor, two ends of the capacitor being the first node and the second node respectively, and the second node connected with the reset circuit, the compensating circuit and the luminance control circuit;

wherein the reset circuit comprises:

a third transistor, a control electrode of the third transistor connected with a first electrode of the third transistor and the reset signal line, and a second electrode of the third transistor connected with the first node.

2. The pixel compensating circuit according to claim 1, wherein the reset circuit further comprises:

a seventh transistor, a control electrode of the seventh transistor connected with the reset signal line and the control electrode of the third transistor, a first electrode of the seventh transistor connected with the data line, and a second electrode of the seventh transistor connected with the second node.

3. The pixel compensating circuit according to claim 2, wherein each of the third transistor and the seventh transistor is a thin film transistor.

4. The pixel compensating circuit according to claim 1, wherein the compensating circuit comprises:

a second transistor, a control electrode of the second transistor connected with the signal control line, a first electrode of the second transistor connected with the second electrode of the first transistor, and a second electrode of the second transistor connected with the first node; and a fourth transistor, a control electrode of the fourth transistor connected with the signal control line, a first electrode of the fourth transistor connected with the data line, and a second electrode of the fourth transistor connected with the second node.

5. The pixel compensating circuit according to claim 4, wherein the compensating circuit further comprises:

an eighth transistor, a control electrode of the eighth transistor connected with a first electrode of the eighth transistor and the signal control line, and a second electrode of the eighth transistor connected with the anode of the display apparatus.

6. The pixel compensating circuit according to claim 5, wherein each of the second transistor and the fourth transistor is a thin film transistor; and the eighth transistor is a thin film transistor.

7. The pixel compensating circuit according to claim 1, wherein the luminance control circuit comprises:

a fifth transistor, a control electrode of the fifth transistor connected with the luminance control line, a first electrode of the fifth transistor connected with a reference voltage end, and a second electrode of the fifth transistor connected with the second node; and a sixth transistor, a control electrode of the sixth transistor connected with the luminance control line, a first electrode of the sixth transistor connected with the second electrode of the first transistor, and a second electrode of the sixth transistor connected with the anode of the display apparatus.

8. The pixel compensating circuit according to claim 7, wherein the display apparatus is an organic light emitting diode, the anode of which is connected with the second electrode of the sixth transistor and a cathode of which is connected with a second voltage end.

9. The pixel compensating circuit according to claim 1, wherein the reset signal, the signal control signal and the luminance control signal respectively correspond to a reset phase, a signal control phase and a luminance control phase.

10. The pixel compensating circuit according to claim 9, wherein during the reset phase, the reset signal is a low voltage level, and the signal control signal and the luminance control signal are high voltage levels.

11. The pixel compensating circuit according to claim 9, wherein during the signal control phase, the reset signal is changed from the low voltage level to a high voltage level, the signal control signal is changed from the high voltage level to the low voltage level, and the luminance control signal is the high voltage level.

12. The pixel compensating circuit according to claim 9, wherein during the luminance control phase, the reset signal is a high voltage level, the signal control signal is changed from the low voltage level to the high voltage level, and the luminance control signal is changed from the high voltage level to the low voltage level.

13. The pixel compensating circuit according to claim 1, wherein the first transistor is a thin film transistor.

14. An array substrate, comprising the pixel compensating circuit according to claim 1.

15. An active-matrix organic light-emitting diode display device, comprising the array substrate according to claim 14.

16. A driving method for the pixel compensating circuit according to claim 1, comprising:

during a reset phase, applying an effective reset signal to the reset signal line to turn on the reset circuit, so as to reset the driving circuit;

during a signal control phase, applying an effective signal control signal to the signal control line to compensate the threshold voltage for the driving circuit and write the data into the driving circuit; and during a luminance control phase, applying an effective luminance control signal to the luminance control line to turn on the luminance control circuit, so as to control the driving circuit to drive the display apparatus to emit light and display.

17. The pixel compensating circuit according to claim 1, wherein the reset circuit further comprises:

the seventh transistor, a control electrode of the seventh transistor connected with the reset signal line and the control electrode of the third transistor, a first electrode of the seventh transistor connected with the data line, and a second electrode of the seventh transistor connected with the second node; and wherein the compensating circuit comprises:

a second transistor, a control electrode of the second transistor connected with the signal control line, a first electrode of the second transistor connected with the second electrode of the first transistor, and a second electrode of the second transistor connected with the first node;

a fourth transistor, a control electrode of the fourth transistor connected with the signal control line, a first electrode of the fourth transistor connected with the data line, and a second electrode of the fourth transistor connected with the second node; and an eighth transistor, a control electrode of the eighth transistor connected with a first electrode of the eighth transistor and the signal control line, and a second electrode of the eighth transistor connected with the anode of the display apparatus.

18. A pixel compensating circuit for an active-matrix organic light-emitting diode, comprising:

a reset circuit, connected with a reset signal line and a driving circuit, and configured to reset the driving circuit according to a reset signal inputted from the reset signal line;

the driving circuit, configured to output a driving current to drive a display apparatus to emit light and display;

a compensating circuit, connected with a signal control line, a data line and the driving circuit, and configured to compensate a threshold voltage for the driving circuit and write data into the driving circuit under control of a signal control signal inputted from the signal control line; and a luminance control circuit, connected with a luminance control line, the driving circuit and an anode of the display apparatus, and configured to control the driving circuit to drive the display apparatus to emit light and display according to a luminance control signal inputted from the luminance control line, wherein the driving circuit comprises:

a first transistor, a control electrode of the first transistor connected with a first node, a first electrode of the first transistor connected with a first voltage end, and a second electrode of the first transistor connected with the compensating circuit and the luminance control circuit; and a capacitor, two ends of the capacitor being the first node and the second node respectively, and the second node connected with the reset circuit, the compensating circuit and the luminance control circuit; and wherein the compensating circuit comprises:

a second transistor, a control electrode of the second transistor connected with the signal control line, a first electrode of the second transistor connected with the second electrode of the first transistor, and a second electrode of the second transistor connected with the first node; and a fourth transistor, a control electrode of the fourth transistor connected with the signal control line, a first electrode of the fourth transistor connected with the data line, and a second electrode of the fourth transistor connected with the second node.

19. The pixel compensating circuit according to claim 18, wherein the compensating circuit further comprises:

an eighth transistor, a control electrode of the eighth transistor connected with a first electrode of the eighth transistor and the signal control line, and a second electrode of the eighth transistor connected with the anode of the display apparatus.

20. A pixel compensating circuit for an active-matrix organic light-emitting diode, comprising:

a reset circuit, connected with a reset signal line and a driving circuit, and configured to reset the driving circuit according to a reset signal inputted from the reset signal line;

the driving circuit, configured to output a driving current to drive a display apparatus to emit light and display;

a compensating circuit, connected with a signal control line, a data line and the driving circuit, and configured to compensate a threshold voltage for the driving circuit and write data into the driving circuit under control of a signal control signal inputted from the signal control line; and a luminance control circuit, connected with a luminance control line, the driving circuit and an anode of the display apparatus, and configured to control the driving circuit to drive the display apparatus to emit light and display according to a luminance control signal inputted from the luminance control line, wherein the driving circuit comprises:

a first transistor, a control electrode of the first transistor connected with a first node, a first electrode of the first transistor connected with a first voltage end, and a second electrode of the first transistor connected with the compensating circuit and the luminance control circuit; and a capacitor, two ends of the capacitor being the first node and the second node respectively, and the second node connected with the reset circuit, the compensating circuit and the luminance control circuit; and wherein the luminance control circuit comprises:

a fifth transistor, a control electrode of the fifth transistor connected with the luminance control line, a first electrode of the fifth transistor connected with a reference voltage end, and a second electrode of the fifth transistor connected with the second node; and a sixth transistor, a control electrode of the sixth transistor connected with the luminance control line, a first electrode of the sixth transistor connected with the second electrode of the first transistor, and a second electrode of the sixth transistor connected with the anode of the display apparatus.

* * * * *